US006101995A

United States Patent [19]

Itoh et al.

[11] Patent Number: 6,101,995

[45] Date of Patent: Aug. 15, 2000

[54] STRUCTURE FOR MOUNTING OF AUXILIARY PARTS ON IN-LINE TYPE MULTI-CYLINDER ENGINE

[75] Inventors: Kenji Itoh; Yasuyo Kosugi; Masaharu Goto, all of Wako, Japan

[73] Assignee: Honda Giken Kogyo Kabushiki Kaisha, Tokyo, Japan

[21] Appl. No.: 09/282,433

[22] Filed: Mar. 31, 1999

[30] Foreign Application Priority Data

Apr. 3, 1998 [JP] Japan ..... 10-091434

[51] Int. Cl.[7] ..... F02F 7/00

[52] U.S. Cl. ..... 123/195 A; 123/195 R

[58] Field of Search ..... 123/195 R, 195 A, 123/198 R, 41.1, 41.44

[56] References Cited

U.S. PATENT DOCUMENTS 4,971,000 11/1990 Shimura et al. ..... 123/195 A
5,704,329 1/1998 Bublitz et al. ..... 123/195 A
5,989,084 11/1999 Tsunoda et al. ..... 123/195 A

FOREIGN PATENT DOCUMENTS 3-4756 2/1991 Japan .

*Primary Examiner*—John Kwon
*Attorney, Agent, or Firm*—Arent Fox Kintner Plotkin & Kahn, PLLC

[57] ABSTRACT

An auxiliary part mounting bracket for an in-line multi-cylinder engine. An oil pump, an auto-tensioner, an alternator, a water pump and a compressor are preassembled on the auxiliary part mounting bracket to form an assembly. This assembly is fixed to a side of the engine cylinder block by six bolts. One bolt is threadedly inserted into the cylinder block through a space defined between the upper oil pump and auto-tensioner and the lower alternator and water pump; two bolts are threadedly inserted into the cylinder block through a space defined between the upper positioned alternator and water pump and the lower positioned compressor. Thus, it is possible to enhance the assembling operation, when the plurality of auxiliary parts are fixed to an engine body through the auxiliary part mounting bracket.

8 Claims, 11 Drawing Sheets

STRUCTURE FOR MOUNTING OF AUXILIARY PARTS ON IN-LINE TYPE MULTI-CYLINDER ENGINE

BACKGROUND OF THE INVENTION

1. Field of the Invention

The present invention relates to a structure for mounting of auxiliary parts on a series or in-line type multi-cylinder engine and particularly for supporting auxiliary parts such as an oil pump for a power steering operation, an alternator, an engine-cooling water pump and an air-conditioning compressor. The auxiliary parts are supported on the engine body through an auxiliary part mounting bracket.

2. Description of the Related Art

There is a known structure for mounting auxiliary parts for a series or in-line type multi-cylinder engine described in Japanese Utility Model Publication No. 3-4756. In this structure, a plurality of auxiliary parts are fixed at vertically multiple stages to a common auxiliary part mounting bracket fastened to an engine body by bolts, and are coupled together by an auxiliary bracket, whereby the rigidity of the auxiliary parts themselves is utilized to enhance the rigidity of mounting of the auxiliary parts to the engine body.

However, the known structure suffers from the problem that much time and labor are required for the auxiliary part assembling operation, because it is required that the auxiliary part mounting bracket should be first fixed to the engine body, the plurality of auxiliary parts should be then fixed to the auxiliary part mounting bracket and further, the parts be coupled together by the auxiliary bracket.

SUMMARY OF THE INVENTION

Accordingly, it is an object of the present invention to enhance the assembling operation when the plurality of auxiliary parts are fixed to the engine body with an auxiliary part mounting bracket.

To achieve the above object, according to a first aspect and feature of the present invention, there is provided a structure for mounting the auxiliary parts on an in-line type multi-cylinder engine, comprising a plurality of auxiliary parts driven by a crankshaft through an endless belt or band, and an auxiliary part mounting bracket for supporting the auxiliary parts on the engine body, the plurality of auxiliary parts being fixed to the auxiliary part mounting bracket by bolts with spaces defined between the auxiliary parts, wherein bolt-fastening portions for fixing the auxiliary part mounting bracket to the engine body are disposed in the spaces.

With the above arrangement, even if the plurality of auxiliary parts are previously fixed to the auxiliary part mounting bracket to form an assembly, the assembly can be fixed collectively to the engine body without interference with the auxiliary parts, because the bolt-fastening portions for fixing the auxiliary part mounting bracket to the engine body are disposed in the spaces between the plurality of auxiliary parts. Thus, it is possible to enhance the auxiliary part assembling operation. Moreover, it is unnecessary to couple the auxiliary parts to one another using the auxiliary bracket and hence, the auxiliary bracket and the bolts for fastening the auxiliary bracket can be eliminated to reduce the number of parts. Further, since all the auxiliary parts are fixed to the common auxiliary part mounting bracket, the rigidity of the auxiliary part mounting bracket can be enhanced by the auxiliary parts themselves, and also the misalignment of each of the auxiliary parts in a direction perpendicular to a rotating plane of the endless belt can be kept to a minimum to enable a smooth transmission of power and to enhance the durability and reliability of the endless belt.

According to a second aspect and feature of the present invention, all the plurality of auxiliary parts driven by the common endless belt are fixed to the common auxiliary part mounting bracket, and disposed spaced apart in the vertical direction of the engine body and alternately displaced in the lateral direction.

With the above arrangement, the plurality of auxiliary parts are disposed in a zigzag manner along the engine body. Therefore, the plurality of auxiliary parts can be laid out rationally in a vertical space along the engine body to provide a reduction in the size of the engine. Also the auxiliary part mounting bracket can be further effectively reinforced by the auxiliary parts themselves disposed in a close relation to one another.

Herein, the term "vertical direction" of the engine body of the in-line type multi-cylinder engine indicates a direction along the cylinder axis of the engine body, and the term "lateral direction" indicates a direction perpendicular to the vertical direction as viewed in the axial direction of the crankshaft.

According to a third aspect and feature of the present invention, a first auxiliary part and a second auxiliary part are fixed in a vertical arrangement to the auxiliary part mounting bracket; a third auxiliary part is fixed to a pair of mounting arms extending integrally from the first auxiliary part; and a fourth auxiliary part is fixed to a pair of mounting arms extending integrally from the second auxiliary part.

With the above arrangement, the first auxiliary part and the second auxiliary part are fixed in the vertical arrangement to the single auxiliary part mounting bracket, and the third and fourth auxiliary parts are fixed to the mounting arms of the first and second auxiliary parts, respectively. Therefore, the rigidity of the auxiliary part mounting bracket can be enhanced by the auxiliary parts themselves. Also the misalignment of each of the auxiliary parts in the direction perpendicular to the rotating plane of the endless belt can be maintained to a minimum to enable the smooth transmission of power and to enhance the durability and reliability of the endless belt. Moreover, an auxiliary bracket is not required in addition to the auxiliary part mounting bracket and hence, the number of parts can be kept to a minimum. Further, the plurality of auxiliary parts can be disposed in close vicinity to one another to reduce the size of the auxiliary part mounting bracket.

According to a fourth aspect and feature of the present invention, the first and second auxiliary parts are driven by an inner peripheral surface of the common endless belt, and the third and fourth auxiliary parts are driven by an outer peripheral surface of the common endless belt.

With the above arrangement, the plurality of auxiliary parts are driven by using the outer and inner peripheral surfaces of the endless belt. Therefore, the auxiliary parts can be disposed in close vicinity to one another to effectively utilize a space, and the auxiliary parts can be reliably driven by the endless belt.

According to a fifth aspect and feature of the present invention, the plurality of auxiliary parts are spaced apart or disposed at multiple stages in a longitudinal direction of the auxiliary part mounting bracket, a water pump which is one of the auxiliary parts being disposed at a substantially central portion of the auxiliary part mounting bracket, and a cooling water passage extending downstream from the water pump is integrally defined in the longitudinal direction of the auxiliary part mounting bracket.

With the above arrangement, the water pump is disposed at the substantially central portion of the auxiliary part mounting bracket for supporting the plurality of auxiliary parts, and the cooling water passage extending downstream from the water pump is integrally defined in the longitudinal direction of the auxiliary part mounting bracket. Therefore, the rigidity of the auxiliary part mounting bracket can be enhanced over a wider region by a space closed in section and defined by the cooling water passage, whereby the plurality of auxiliary parts can be firmly supported on the auxiliary part mounting bracket. Moreover, the plurality of auxiliary parts supported on the auxiliary part mounting bracket can be cooled by cooling water flowing through the cooling water passage defined in the auxiliary part mounting bracket.

According to a sixth aspect and feature of the present invention, an alternator which is one of the plurality of auxiliary parts, is disposed in the vicinity of the water pump.

With the above arrangement, since the alternator producing heat of a large calorific value, is mounted in the vicinity of the water pump, the alternator can be effectively cooled by cooling water flowing through the water pump without providing special cooling means.

According to a seventh aspect and feature of the present invention, a thermo-case having a thermostat accommodated therein, is integrally formed on the auxiliary part mounting bracket, and a cooling water passage extending from the thermo-case to the water pump is integrally defined in a direction perpendicular to the longitudinal direction of the auxiliary part mounting bracket in the vicinity of the alternator.

With the above arrangement, since the thermo-case is integrally formed on the auxiliary part mounting bracket, the number of parts is reduced, as compared with a separate thermo-case fixed to the auxiliary part mounting bracket. Moreover, the water pump and the thermo-case are connected to each other by the cooling water passage defined in the auxiliary part mounting bracket and hence, a special cooling water pipe is not required, leading to a reduced number of parts. In addition, since the cooling water passage extending downstream from the water pump, is defined in the longitudinal direction of the auxiliary part mounting bracket and the cooling water passage extending upwards of the water pump and connected to the thermo-case, is defined in the direction perpendicular to the longitudinal direction of the auxiliary part mounting bracket, the auxiliary part mounting bracket can be further reinforced by the cooling water passages and moreover, can be cooled more effectively.

According to an eighth aspect and feature of the present invention, the auxiliary part mounting bracket is disposed at one end of the side of the engine body in an axial direction of the crankshaft, and an intake manifold is disposed at the other end in the axial direction.

With the above arrangement, since the auxiliary part mounting bracket and the intake manifold are disposed at opposite ends of the side of the engine body in the axial direction of the crankshaft, respectively, the space defined on the side of the engine body can be effectively utilized, while avoiding the interference of the auxiliary part mounting bracket with the intake manifold.

The above and other objects, features and advantages of the invention will become apparent from the following description of the preferred embodiments taken in conjunction with the accompanying drawings.

DETAILED DESCRIPTION OF THE PREFERRED EMBODIMENTS

A first embodiment of the present invention will now be described with reference to FIGS. 1 to 10.

Figure 1:
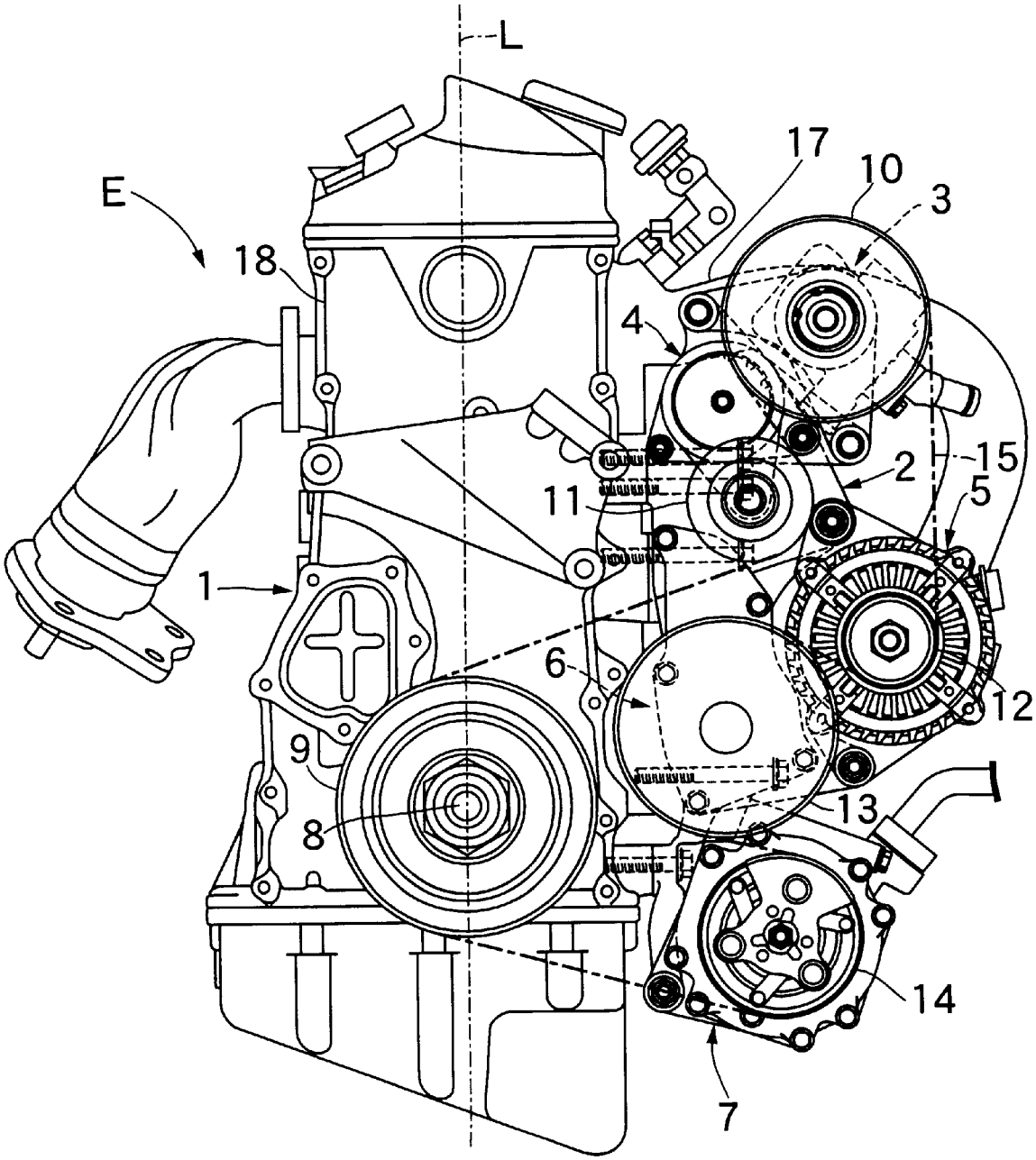
FIG. 1 is a front view of a series or in-line type multi-cylinder engine as viewed in an axial direction of a crankshaft.

As shown in FIG. 1, an auxiliary part mounting bracket 2 is fixed to a side of a cylinder block 1 of an engine body of a series or in-line type multi-cylinder engine E. An oil pump 3 for a power steering operation, an auto-tensioner 4, an alternator 5, an engine-cooling water pump 6 and an air-conditioning compressor 7, which are auxiliary parts, are fixed to the auxiliary part mounting bracket 2. The five auxiliary parts 3 to 7 are disposed vertically (in a direction along a cylinder axis L in FIG. 1) along the engine and disposed or displaced alternately laterally (in a direction perpendicular to the cylinder axis L in FIG. 1). This will be described in more detail. Relatively smaller ones of the five auxiliary parts 3 to 7, i.e., the auto-tensioner 4 second from the top and the water pump 6 fourth from the top are disposed on a front surface of the auxiliary part mounting bracket 2 at locations closer to the cylinder block 1, and the relatively larger ones, i.e., the oil pump 3 first from the top, the alternator 5 third from the top and the compressor 7 fifth from the top are disposed on an outer surface of the auxiliary part mounting bracket 2 at locations further from the cylinder block 1.

A single endless band or endless belt 15 is reeved around a crank pulley 9 mounted on a crankshaft 8 in the engine E, an oil pump pulley 10 mounted on the oil pump 3, a tensioner pulley 11 mounted on the auto-tensioner 4, an alternator pulley 12 mounted on the alternator 5, a water pump pulley 13 mounting on the water pump 6 and a compressor pulley 14 mounted on the compressor 7. Thus, the driving force of the crankshaft 8 is transmitted to the oil pump 3, the alternator 5, the water pump 6 and the compressor 7 by the endless belt 15, and tension is applied to the endless belt 15 by the auto-tensioner 4.

The five auxiliary parts 3 to 7 can be rationally laid out in the space defined along the cylinder block 1 to provide a reduction in size of the engine E by disposing the auxiliary parts vertically and in a zigzag manner along the side of the cylinder block 1, in the above manner. The tensioner pulley 11 and the water pump pulley 13 are driven by the rear surface of the endless belt 15, and by using the single endless belt 15 and by utilizing the rear surface of the endless belt 15, the auxiliary parts 3 to 7 can be disposed compactly in a state in which they are close to one another, and also a sufficient angle of endless belt 15 wound around each of the pulleys 10 to 14, can be ensured to reliably drive the auxiliary parts 3 to 7.

Figure 2:
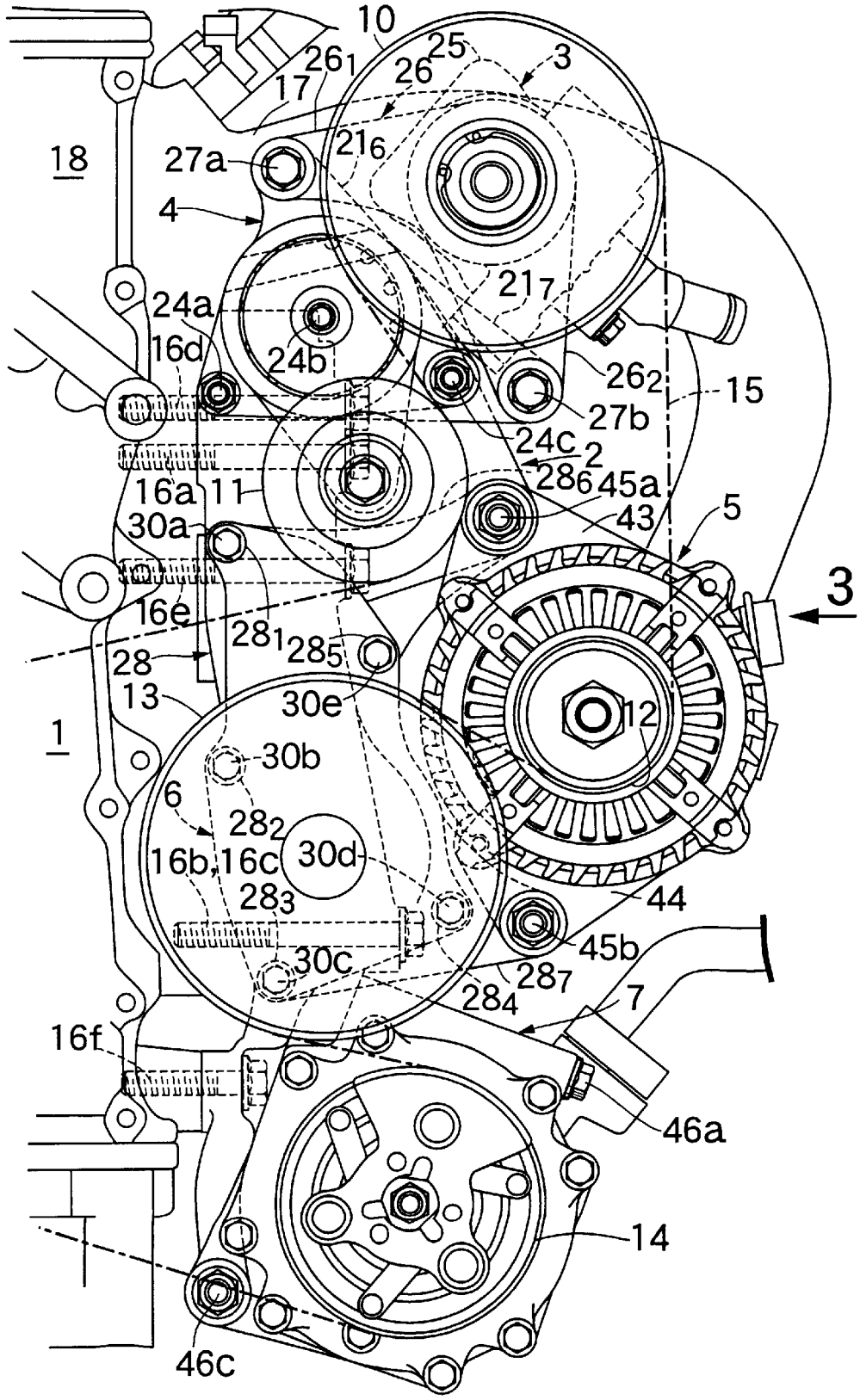
FIG. 2 is an enlarged view of an essential portion shown in FIG. 1.
Figure 3:
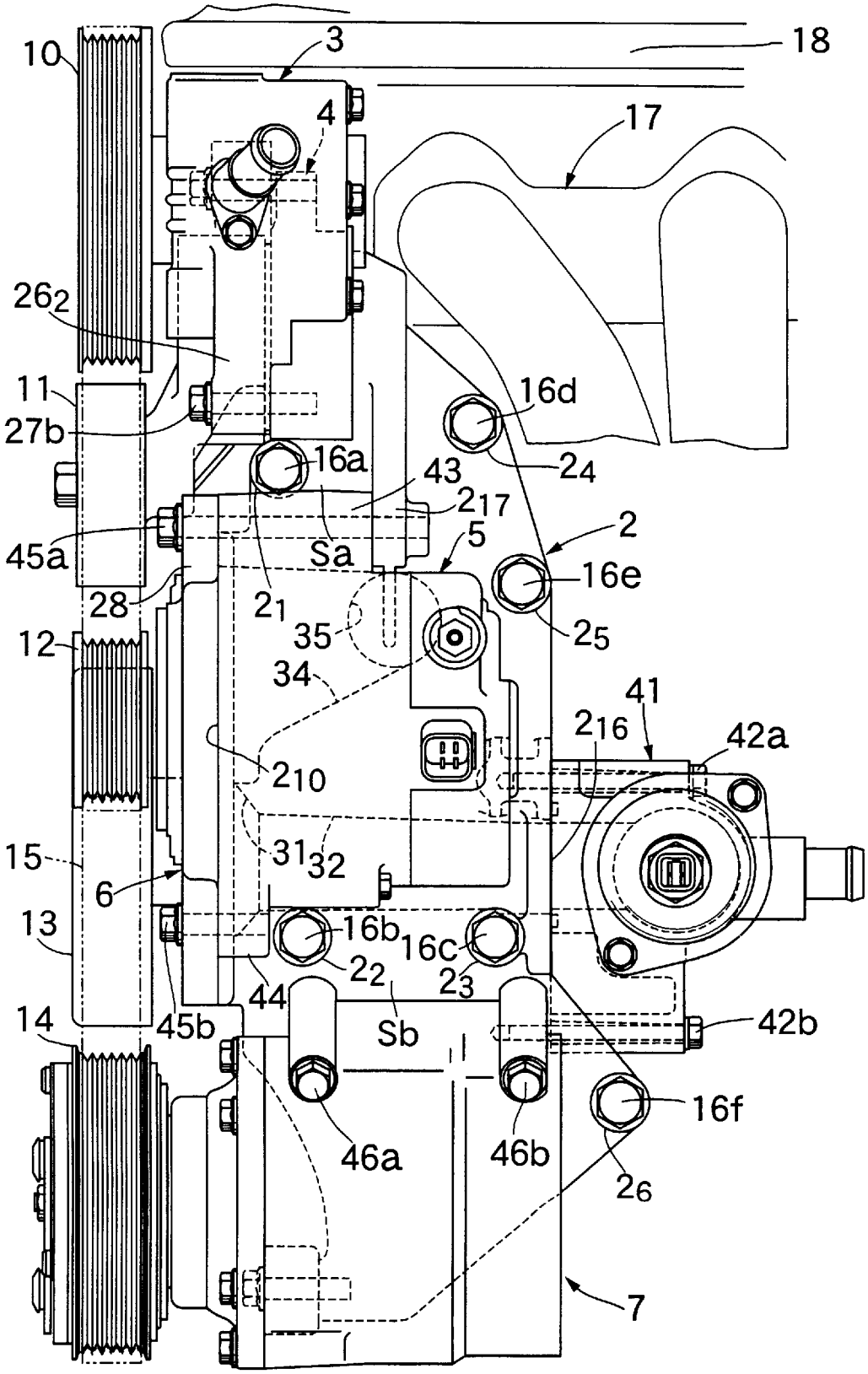
FIG. 3 is a view taken in the direction of an arrow 3 in FIG. 2.

As can be seen from FIGS. 2 and 3, the auxiliary part mounting bracket 2 includes six bolt-fastening portions $\mathbf{2}_1$, $\mathbf{2}_2$, $\mathbf{2}_3$, $\mathbf{2}_4$, $\mathbf{2}_5$ and $\mathbf{2}_6$, so that the auxiliary part mounting bracket 2 can be fastened to the side of the cylinder block 1 by six bolts 16*a*, 16*b*, 16*c*, 16*d*, 16*e* and 16*f* passing through the bolt-fastening portions $\mathbf{2}_1$, $\mathbf{2}_2$, $\mathbf{2}_3$, $\mathbf{2}_4$, $\mathbf{2}_5$ and $\mathbf{2}_6$ from the side. One bolt 16*a* passes through the bolt fastening portion $\mathbf{2}_1$ of the auxiliary part mounting bracket 2 and is threadedly inserted into the cylinder block 1 through a space Sa defined between the upper-side oil pump 3 and auto-tensioner 4 and the lower-side alternator 5 and water pump 6, and the two bolts 16*b* and 16*c* pass through the bolt-fastening portions $\mathbf{2}_2$ and $\mathbf{2}_3$ and are threadedly inserted into the cylinder block 1 through a space Sb defined between the upper-side alternator 5 and water pump 6 and the lower-side compressor 7. The remaining three bolts 16*d* to 16*f* pass through the bolt-fastening portions $\mathbf{2}_4$ to $\mathbf{2}_6$ of the auxiliary part mounting bracket 2 and are threadedly inserted into the cylinder block 1 through the auxiliary part mounting bracket 2 at locations away from the five auxiliary parts 3 to 7.

In this way, the six bolts 16*a* to 16*f* can be threadedly inserted into the cylinder block 1 without interference with the auxiliary parts 3 to 7. Therefore, all the auxiliary parts 3 to 7 can be preassembled onto the auxiliary part mounting bracket 2 to form an assembly, and the assembly can be fastened to the cylinder block 1 collectively by the six bolts 16*a* to 16*f*. As a result, it is possible not only to remarkably enhance the assembling operation for the auxiliary parts 3 to 7, and also to maintain the number of bolts and auxiliary brackets required for mounting of the auxiliary parts 3 to 7 to a minimum and to reduce the number of components. In addition, since all the auxiliary parts 3 to 7 are fixed to the common auxiliary part mounting bracket 2, the relative misalignment of each of the auxiliary parts 3 to 7 (especially, the misalignment in a direction perpendicular to the rotating plane of the endless belt 15) can be reduced to a minimum to enable the smooth transmission of power and to enhance the durability and reliability of the endless belt 15.

As can be seen from FIGS. 1 to 3, an intake manifold 17 of the engine E is connected to a cylinder head 18 coupled to an upper portion of the cylinder block 1. The auxiliary parts 3 to 7 supported on the auxiliary part mounting bracket 2 and the intake manifold 17 are disposed separately on the side of the engine E, so that they are positioned on axially opposite ends of the crankshaft 8 (laterally as viewed in FIG. 3). Therefore, the auxiliary part mounting bracket 2 can be prevented from interfering with the intake manifold 17 to thus effectively utilize the space defined on the side of the engine E.

The structure for mounting of the auxiliary parts 3 to 7 will be described below in detail.

(1) Auto-Tensioner

First, the outline structure of the auto-tensioner 4 will be described with reference to FIG. 8. The auto-tensioner 4 includes a base member 21 formed of a generally triangular plate material, and the tensioner pulley 11 is rotatably supported at a tip end of an arm 23 which is swingably supported on the base member 21 with a bearing 22 interposed therebetween. To resiliently bring the tensioner pulley 11 into pressure contact with the endless belt 15, the arm 23 is biased in the direction of arrow A by a spring (not shown) mounted between the arm 23 and the base member 21.

The base member 21 is provided with five bolt-fastening portions $\mathbf{21}_1$, $\mathbf{21}_2$, $\mathbf{21}_3$, $\mathbf{21}_4$ and $\mathbf{21}_5$, so that the auto-tensioner 4 is fixed to the auxiliary part mounting bracket 2 by threadedly inserting three bolts 24*a*, 24*b* and 24*c* passing through three bolt-fastening portions $\mathbf{21}_1$, $\mathbf{21}_2$ and $\mathbf{21}_3$, of the five bolt-fastening portions into three bolt-fastening portions $\mathbf{2}_7$, $\mathbf{2}_8$ and $\mathbf{2}_9$ (see FIG. 4) of the auxiliary part mounting bracket 2.

(2) Oil Pump

Figure 8:
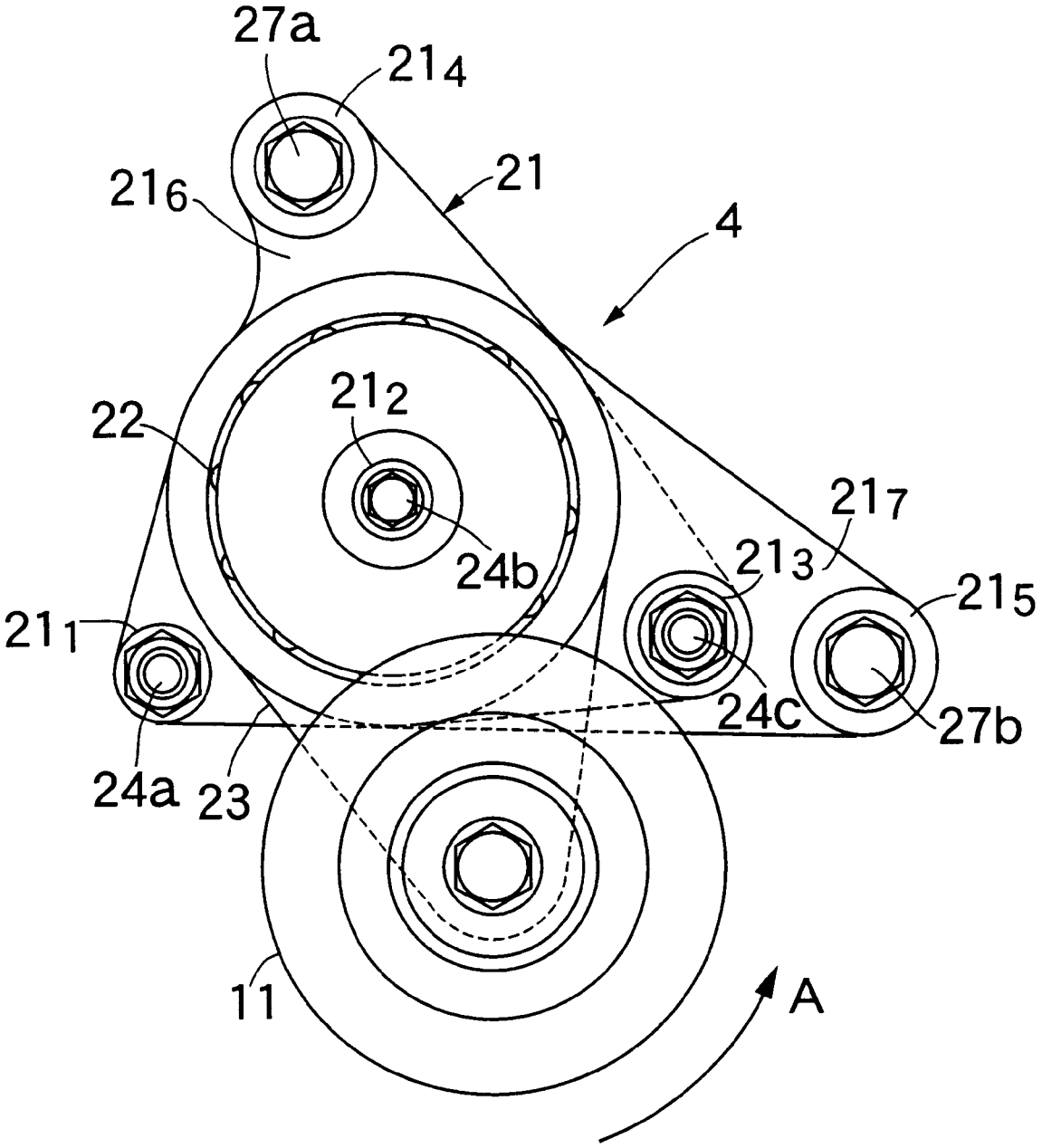
FIG. 8 is a front view of an auto-tensioner.
Figure 9:
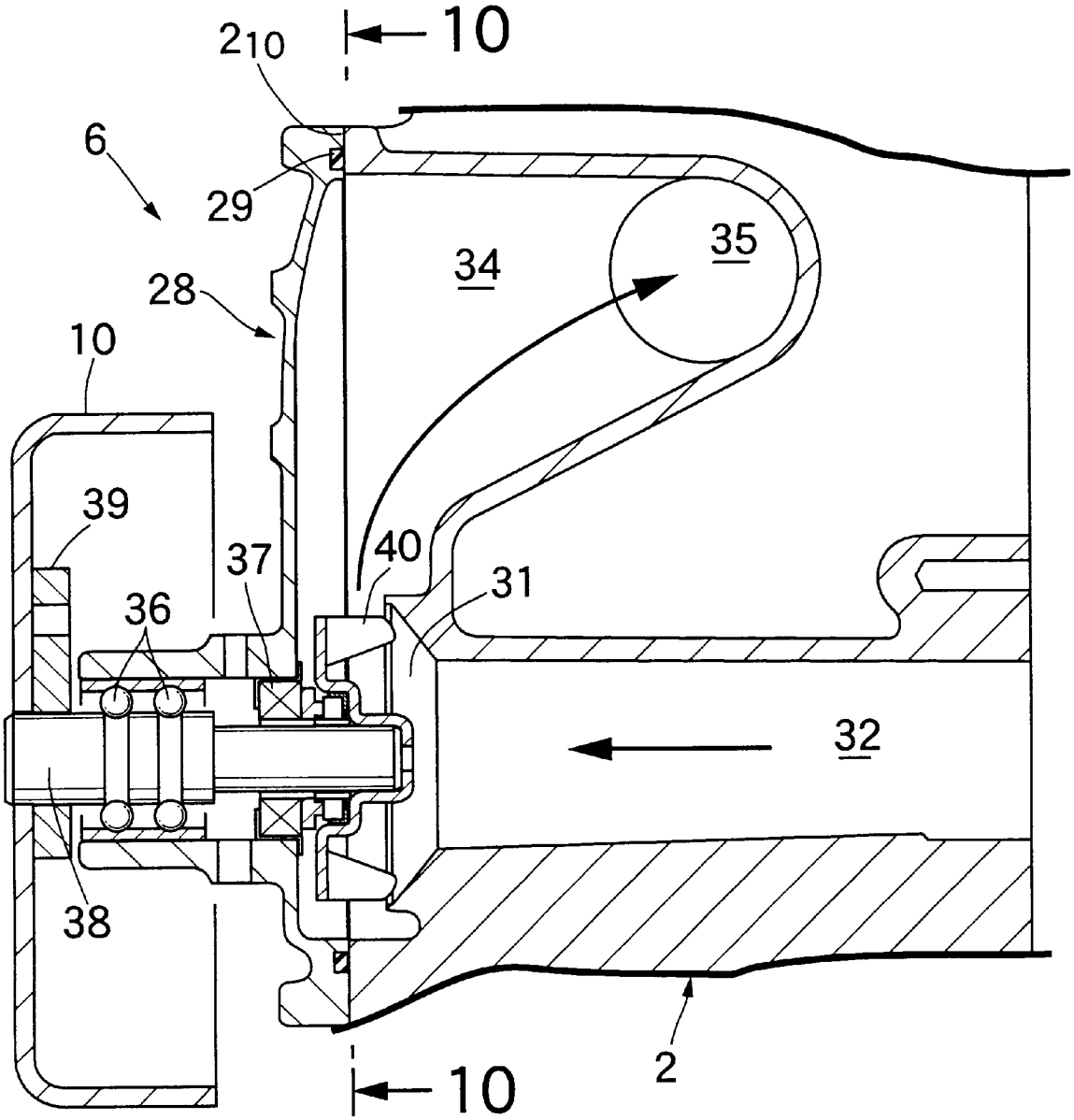
FIG. 9 is a sectional view taken along a line 9—9 in FIG. 4.
Figure 10:
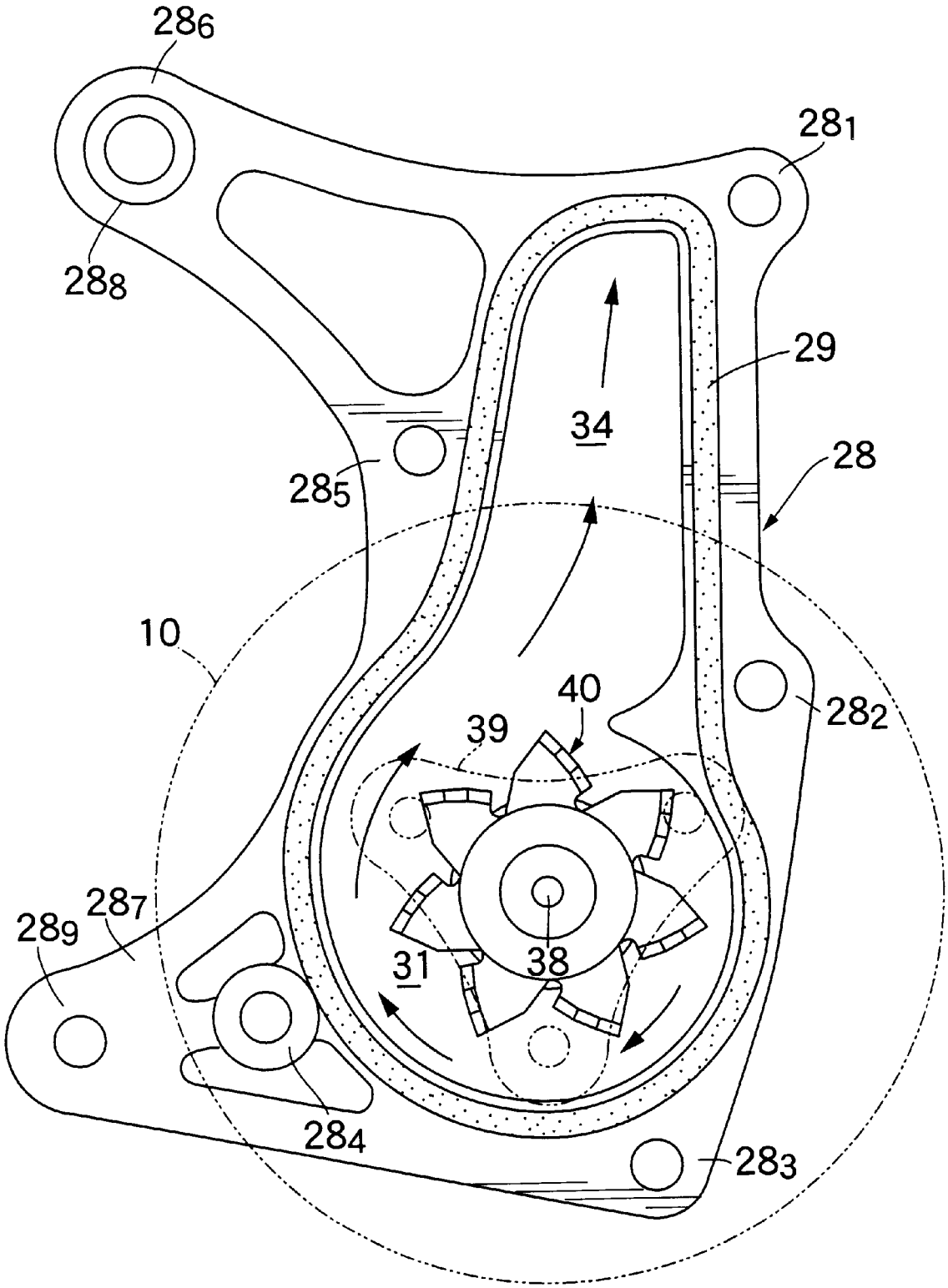
FIG. 10 is a sectional view taken along a line 10—10 in FIG. 9.

As shown in FIGS. 2 and 8, the base member 21 of the auto-tensioner 4 has two mounting arm portions $\mathbf{21}_6$ and $\mathbf{21}_7$ extending upwards and sideways. A pair of mounting arm portions $\mathbf{26}_1$ and $\mathbf{26}_2$ provided on the plate-shaped base 26 supporting a pump body 25 of the oil pump 3 is fixed, by two bolts 27*a* and 27*b*, to the bolt-fastening portions $\mathbf{21}_4$ and $\mathbf{21}_5$ provided at the tip ends of the mounting arm portions $\mathbf{21}_6$ and $\mathbf{21}_7$. Namely, the oil pump 3 is fixed indirectly to the auxiliary part mounting bracket 2 through the auto-tensioner 4.

(3) Water Pump

Figure 4:
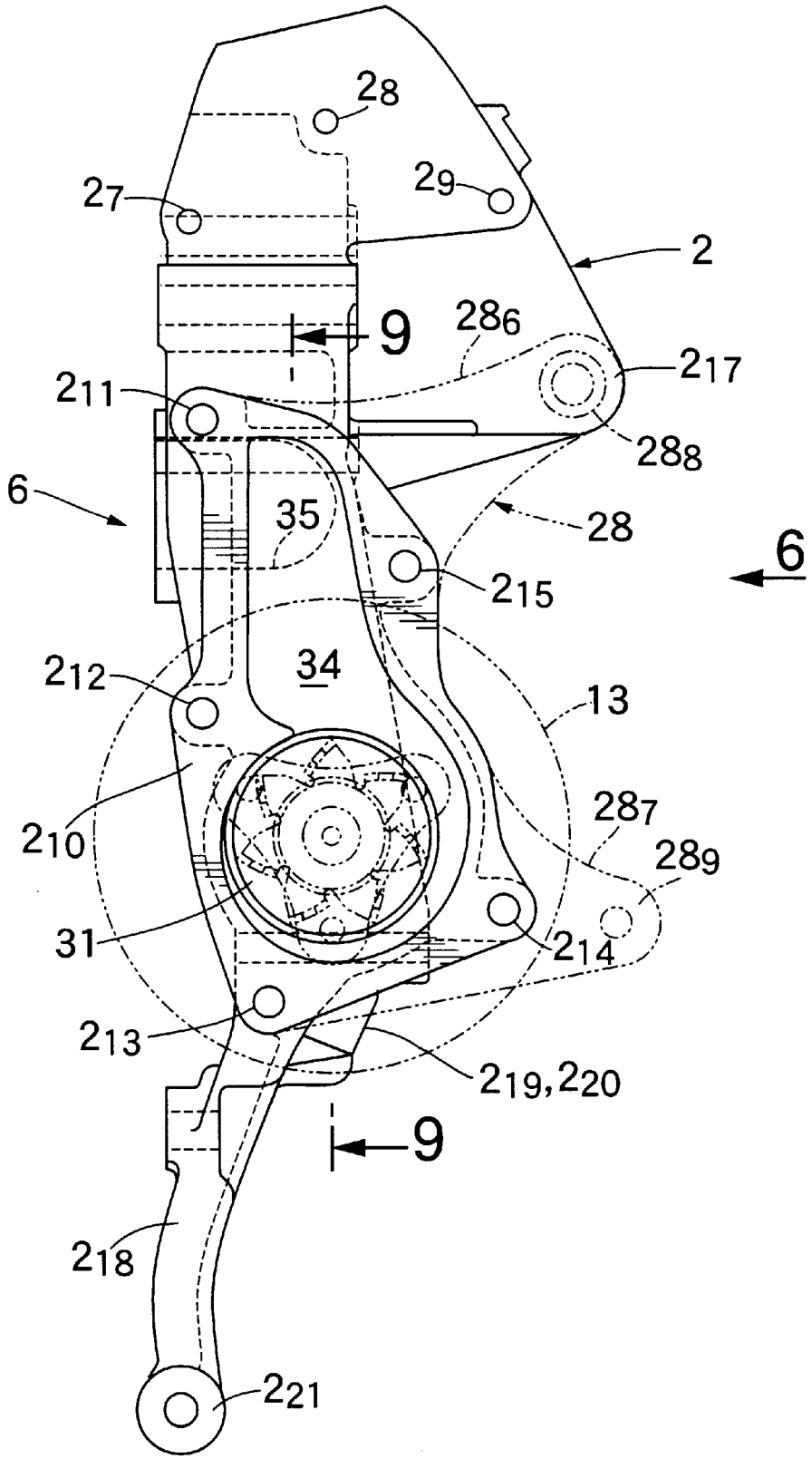
FIG. 4 is a front view of an auxiliary part mounting bracket.

As shown in FIG. 4, a flat mounting seat $\mathbf{2}_{10}$ is formed on a front surface of the auxiliary part mounting bracket 2, and five bolt-fastening portions $\mathbf{2}_{11}$, $\mathbf{2}_{12}$, $\mathbf{2}_{13}$, $\mathbf{2}_{14}$ and $\mathbf{2}_{15}$ are formed on the mounting seat $\mathbf{2}_{10}$. As can be seen from FIGS. 2, 9 and 10, a plate-shaped pump cover 28 is superposed on the mounting seat $\mathbf{2}_{10}$ with a seal member 29 interposed therebetween. The pump cover 28 has five bolt-fastening portions $\mathbf{28}_1$, $\mathbf{28}_2$, $\mathbf{28}_3$, $\mathbf{28}_4$ and $\mathbf{28}_5$ on its outer periphery, whereby the pump cover 28 is fastened to the auxiliary part mounting bracket 2 by threadedly inserting five bolts 30*a*, 30*b*, 30*c*, 30*d* and 30*e* through the bolt-fastening portions $\mathbf{28}_1$, $\mathbf{28}_2$, $\mathbf{28}_3$, $\mathbf{28}_4$ and $\mathbf{28}_5$ into five bolt-fastening portions $\mathbf{2}_{11}$, $\mathbf{2}_{12}$, $\mathbf{2}_{13}$, $\mathbf{2}_{14}$ and $\mathbf{2}_{15}$ of the mounting seat $\mathbf{2}_{10}$.

Defined inside the mounting seat $\mathbf{2}_{10}$ are a pump chamber 31 in which a pump rotor 40 which will be described hereinafter is rotatably accommodated, a rectilinear cooling-water passage 32 extending from the pump chamber 31 to a back of the auxiliary part mounting bracket 2, a cooling-water passage 34 extending upwards from the pump chamber 31 along the mounting seat $\mathbf{2}_{10}$, and a cooling-water passage 35 curving from an upper end of the cooling-water passage 34 toward the cylinder block 1.

A pump shaft 38 is rotatably carried on the pump cover 28 with a ball bearing 36 and a seal member 37 interposed therebetween. The oil pump pulley 10 is fixed to one end of the pump shaft 38 with a mounting member 39, and the pump rotor 40 within the pump chamber 31 is fixed to the other end of the pump shaft 38. The pump cover 28 has two mounting arms $\mathbf{28}_6$ and $\mathbf{28}_7$, which have bolt-fastening portions $\mathbf{28}_8$ and $\mathbf{28}_9$ formed at tip ends thereof, respectively.

Figure 5:
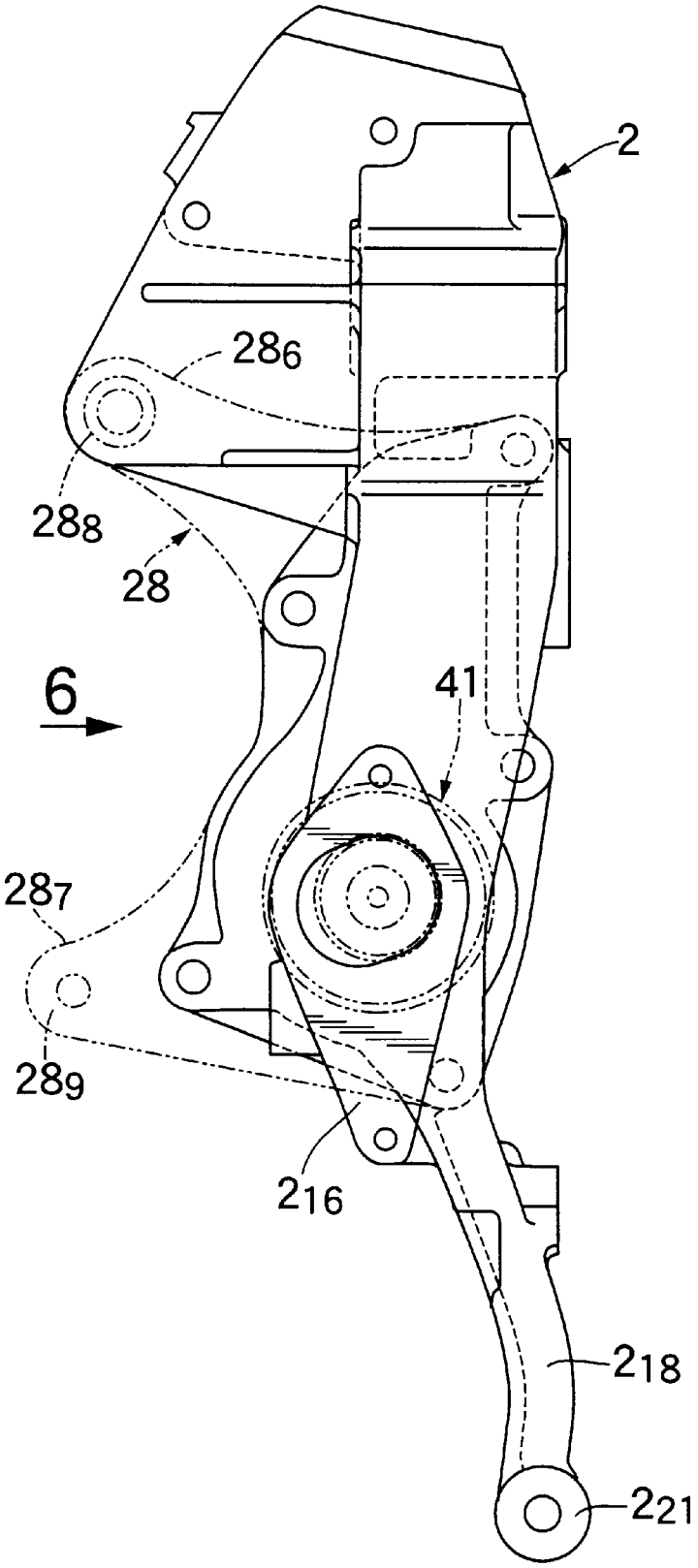
FIG. 5 is a back view of the auxiliary part mounting bracket.

As shown in FIGS. 3 and 5, a flat mounting seat $\mathbf{2}_{16}$, into which the cooling water passage 32 opens, is formed on the back of the auxiliary part mounting bracket 2. A thermo-case 41 having a thermostat accommodated therein, is fixed to the mounting seat $\mathbf{2}_{16}$ by two bolts 42*a* and 42*b*.

After completion of the warming operation of the engine E, cooling water from a radiator (not shown) is supplied to a cooling water passage (not shown) within the cylinder block 1 via the thermo-case 41, the cooling water passage 32 in the auxiliary part mounting bracket 2, the pump chamber 31 in the water pump 6, the cooling water passage 34 in the auxiliary part mounting bracket 2 and the cooling water passage 35 in the auxiliary part mounting bracket 2. Before completion of the warming operation of the engine E, cooling water from the engine E flows via a cooling water passage by-passing the radiator (not shown), directly to the thermo-case 41 to promote the warming of the engine E.

(4) Alternator

As shown in FIG. 2, the alternator 5 has a pair of mounting arms 43 and 44, and a bolt 45*a* passes through the upper mounting arm 43 and the bolt-fastening portion $\mathbf{28}_8$ provided on the mounting arm $\mathbf{28}_6$ of the pump cover 28, and is threadedly inserted into a bolt-fastening portion $\mathbf{2}_{17}$ (see FIG. 4) of the auxiliary part mounting bracket 2. Further, a bolt 45*b* passes through the lower mounting arm 44 of the alternator 5 and is threadedly inserted into the bolt-fastening portion $\mathbf{28}_9$ provided on the mounting arm $\mathbf{28}_7$ of the pump cover 28. Namely, the bolt 45*a* commonly fastens the alternator 5 and the water pump 6 to the auxiliary part mounting bracket 2, and the bolt 45*b* fastens the alternator 5 to the water pump 6.

(5) Compressor

Figure 6:
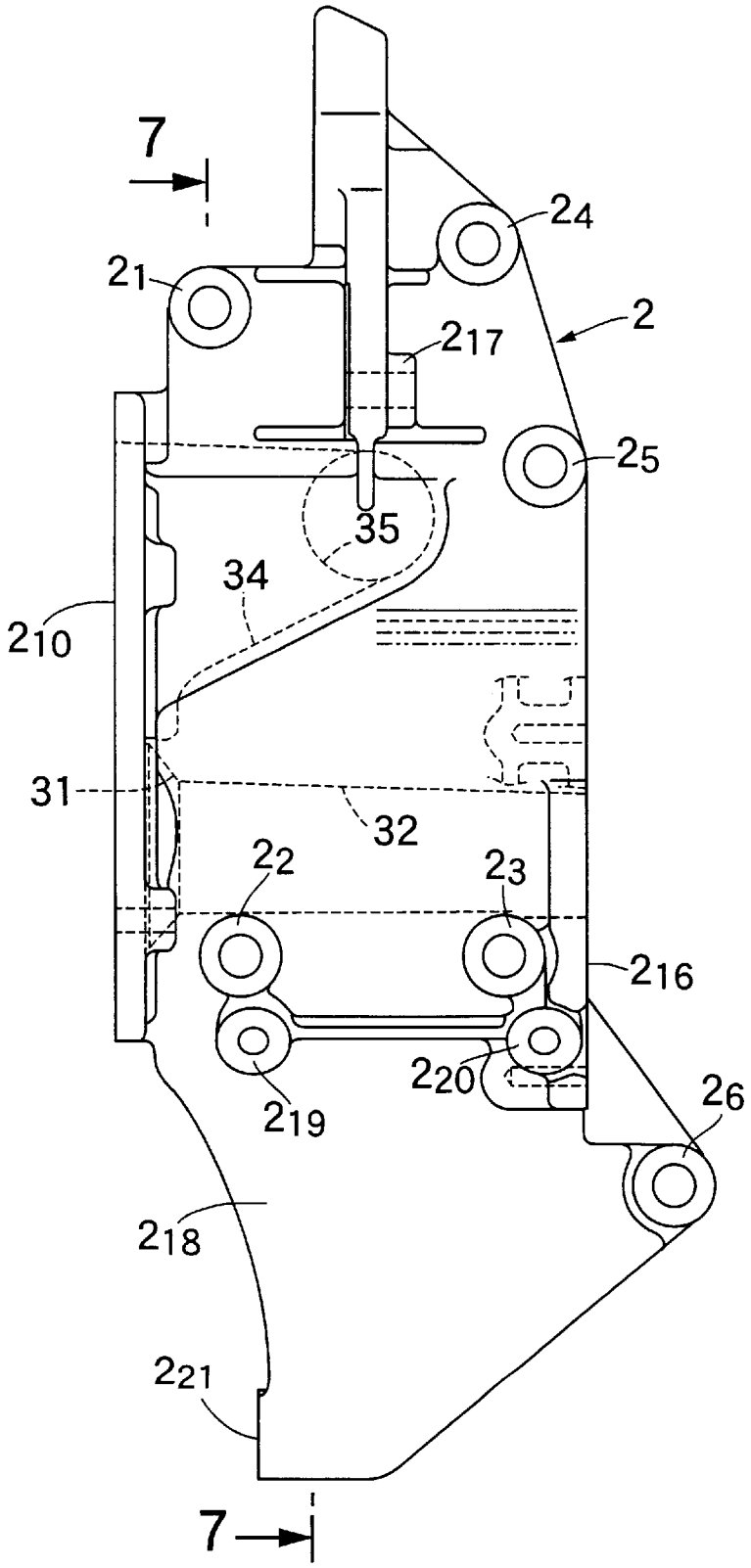
FIG. 6 is a view taken in a direction of an arrow 6 in FIGS. 4 and 5.
Figure 7:
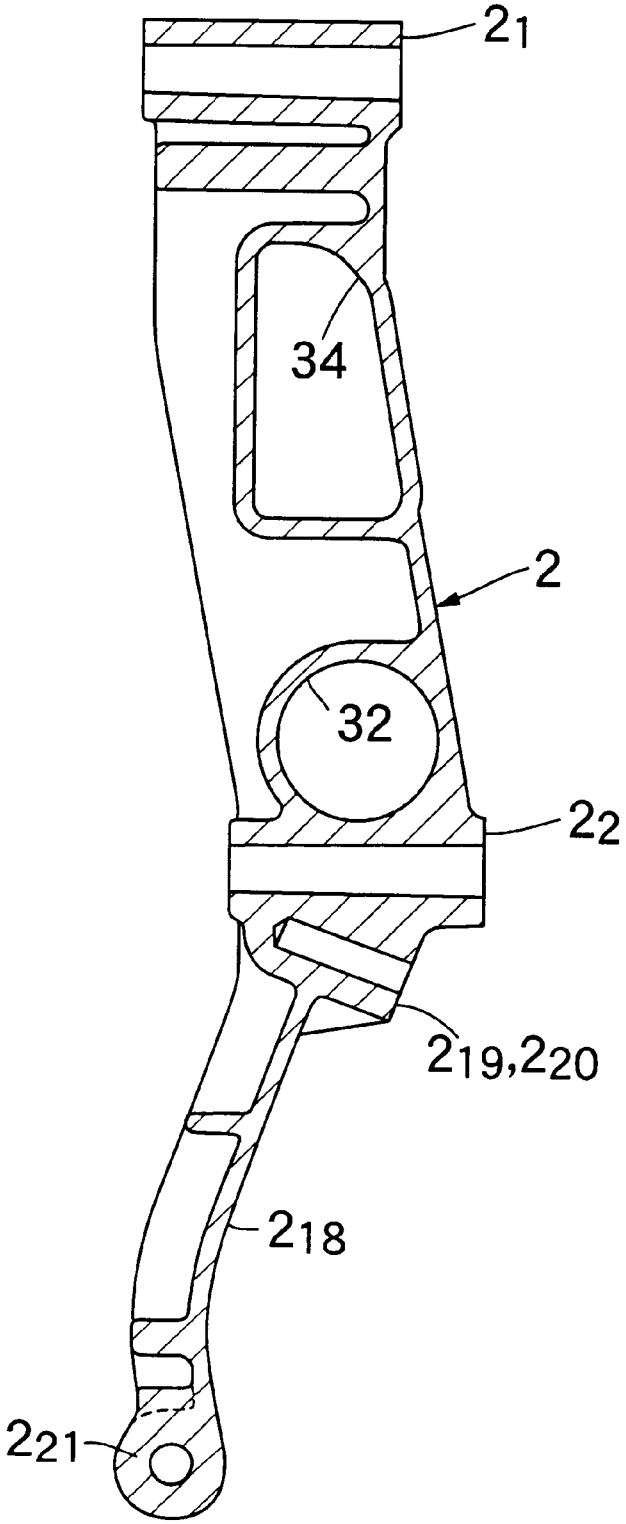
FIG. 7 is a sectional view taken along a line 7—7 in FIG. 6.

As shown in FIGS. 4 and 6, a single leg $\mathbf{2}_{18}$ extends downwards from a lower end of the auxiliary part mounting bracket 2. Two bolt-fastening portions $\mathbf{2}_{19}$ and $\mathbf{2}_{20}$ are formed at a base end of the leg $\mathbf{2}_{18}$, and a single bolt-fastening portion $\mathbf{2}_{21}$ is formed at a tip end of the leg $\mathbf{2}_{18}$. The compressor 7 is fixed to the auxiliary part mounting bracket 2 by threadedly inserting bolts 46*a* and 46*b* passing through the compressor 7 from its side, into the bolt-fastening portions $\mathbf{2}_{19}$ and $\mathbf{2}_{20}$ (see FIG.3) and threadedly inserting a bolt 46*c* passing through the compressor 7 from its front surface, into the bolt-fastening portion $\mathbf{2}_{21}$ (see FIG. 2).

As described above, the auxiliary part mounting bracket 2 supporting the auxiliary parts 3 to 7, has a three-dimensional cubic shape rather than a simple plate-shaped shape. An upper portion (a portion above the leg $\mathbf{2}_{18}$) of the auxiliary part mounting bracket 2 is formed to have a substantially flat surface to permit the oil pump 3, the auto-tensioner 4, the alternator 5 and the water pump 6 to be mounted thereon, and a lower portion (the leg $\mathbf{2}_{18}$) of the auxiliary part mounting bracket 2 supporting the compressor 7 is formed flat in the direction intersecting the flat surface at the upper portion of the auxiliary part mounting bracket 2 at approximately 90°. Therefore, the upper and lower portions reinforce each other, whereby the rigidity of the entire auxiliary part mounting bracket 2 is enhanced.

Moreover, by fixing the five auxiliary parts 3 to 7 to the auxiliary part mounting bracket 2, the auxiliary part mounting bracket 2 can be reinforced by the auxiliary parts 3 to 7, whereby the rigidity can be further increased. Especially, the oil pump 3 is supported on the auxiliary part mounting bracket 2 through the mounting arms $\mathbf{21}_6$ and $\mathbf{21}_7$ of the auto-tensioner 4 fixed directly to the auxiliary part mounting bracket 2, and the alternator 5 is supported on the auxiliary part mounting bracket 2 through the mounting arms $\mathbf{28}_6$ and $\mathbf{28}_7$ of the water pump 6 fixed directly to the auxiliary part mounting bracket 2. Therefore, the oil pump 3 and the alternator 5 can be allowed to function as reinforcing members without the addition of a special auxiliary bracket, to thereby contribute to an enhancement in rigidity of the auxiliary part mounting bracket 2. Further, the auxiliary parts 3 to 7 can be laid out compactly in a state in which they are in a close relation with one another.

Among the auxiliary parts 3 to 7 generating heat with the operation of the engine E, the calorific value of the alternator 5 is particularly large. For this reason, to maintain the power generating efficiency, it is necessary to cool the alternator 5. Because the water pump 6 is disposed at the substantially central portion of the vertical length of the auxiliary part mounting bracket 2 and the alternator 5 is disposed in the vicinity of the water pump 6, it is possible to cool the alternator 5 by cooling water flowing through the cooling water passages 32, 34, 35 defined in the auxiliary part mounting bracket 2 and through the pump chamber 31. Therefore, it is unnecessary to provide a special cooling device for cooling the alternator 5.

In addition, the substantially central portion of the auxiliary part mounting bracket 2 is provided with the cooling water passage 34 (see FIG. 4) which is closed in section and which extends in the longitudinal direction (the vertical direction) of the auxiliary part mounting bracket 2, and the cooling water passage 35 (see FIG. 4) which is closed in section and which is connected to the cooling water passage 34 and extends in a direction perpendicular to the longitudinal direction. Therefore, the rigidity of the auxiliary part mounting bracket 2 can be enhanced over its wider region without increasing the weight due to the cooling water passages 34 and 35.

Further, the other cooling water passage 32 (see FIG. 6) has a closed section and is defined in the substantially central portion of the auxiliary part mounting bracket 2 and extends in the direction perpendicular to the direction of the cooling water passages 34 and 35. This can effectively contribute to the enhancement of the rigidity of the auxiliary part mounting bracket 2. Moreover, since the water pump 6 and the thermo-case 41 are disposed at the opposite ends of the cooling water passage 32, a cooling water pipe connecting the thermo-case 41 to the water pump 6 is not required, whereby the number of parts can be reduced.

Figure 11:
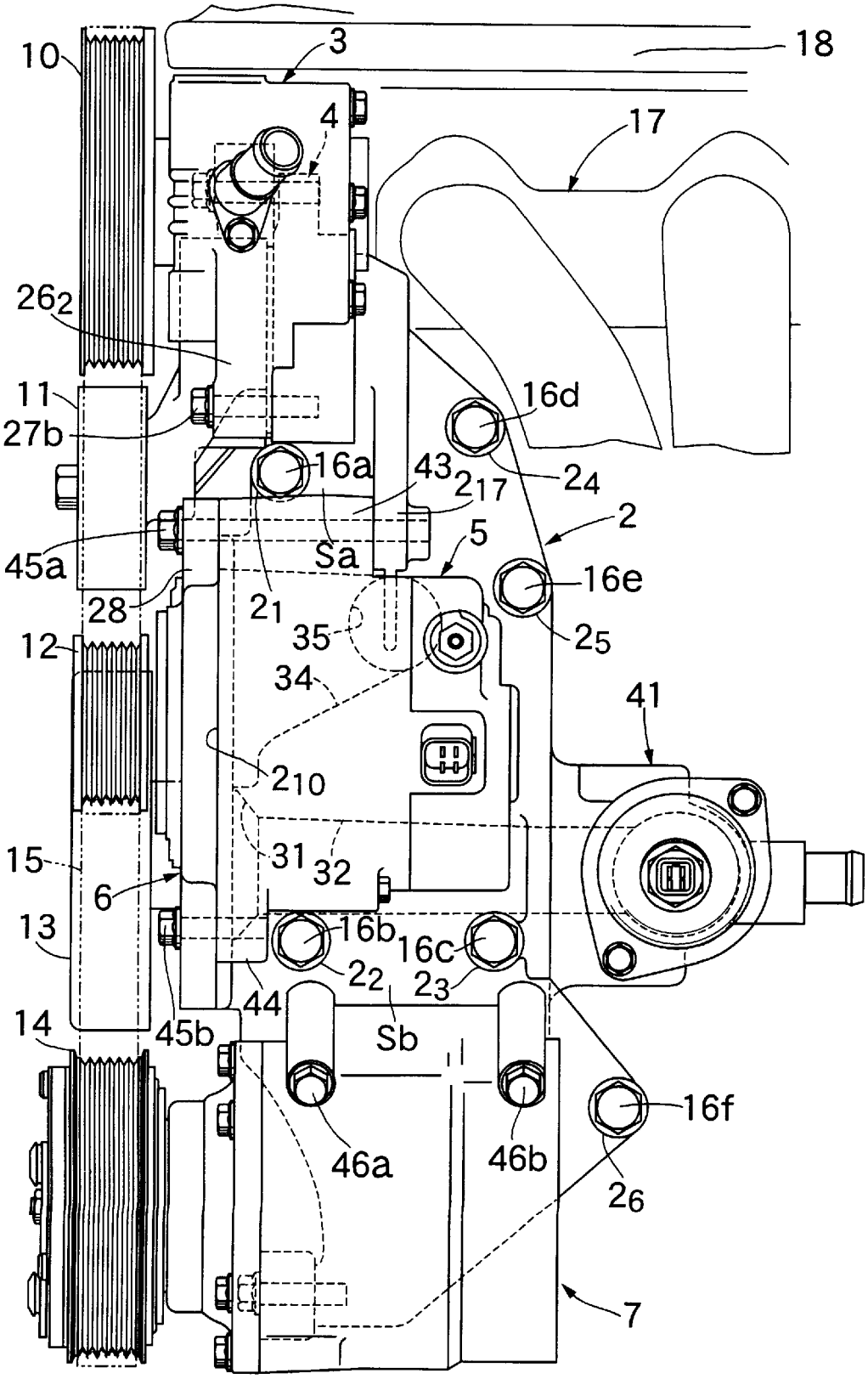
FIG. 11 is a view similar to FIG. 3, but according to a second embodiment.

FIG. 11 shows a second embodiment of the present invention. The thermo-case 41 is fixed to the auxiliary part mounting bracket 2 by the bolts 42*a* and 42*b* in the above-described first embodiment, but in the second embodiment, the thermo-case 41 is integrally formed on an auxiliary part mounting bracket 2. Thus, separate thermo-case 41 and bolts 42*a* and 42*b* are not required, leading to a further reduction in the number of parts.

The oil pump 3 for the power steering operation, the auto-tensioner 4, the alternator 5, the engine-cooling water pump 6 and the air-conditioning compressor 7 have been illustrated as auxiliary parts in the above embodiments, but the present invention is applicable to any other auxiliary parts. In addition, an endless chain may be used in place of the endless belt 15.

Although the embodiments of the present invention have been described in detail, it will be understood that the present invention is not limited to the above-described embodiments, and various modifications may be made without departing from the spirit and scope of the invention defined in claims.

What is claimed is:

1. A structure for mounting auxiliary parts on an in-line type multi-cylinder engine having a crankshaft and an end less belt operatively connected thereto, comprising a plurality of auxiliary parts, the endless belt operatively connecting the crankshaft and said plurality of auxiliary parts, an auxiliary part mounting bracket for supporting said auxiliary parts on the engine body, bolts for fixing said plurality of auxiliary parts to said auxiliary part mounting bracket with spaces defined between said auxiliary parts, and bolt-fastening portions for fixing said auxiliary part mounting bracket to the engine body, the bolt fastening portions being disposed in said spaces between said auxiliary parts.

2. A structure for mounting auxiliary parts on an in-line type multi-cylinder engine according to claim 1, wherein said plurality of auxiliary parts are fixed to said auxiliary part mounting bracket, and are disposed spaced apart in the vertical direction of the engine body and are alternately displaced in the lateral direction.

3. A structure for mounting auxiliary parts on an in-line type multi-cylinder engine according to claim 1, wherein a first auxiliary part and a second auxiliary part of said plurality of auxiliary parts are fixed to said auxiliary part mounting bracket in a vertical relationship; a third auxiliary part of said plurality of auxiliary parts is fixed to a pair of mounting arms extending integrally from said first auxiliary part; and a fourth auxiliary part of said plurality of auxiliary parts is fixed to a pair of mounting arms extending integrally from said second auxiliary part.

4. A structure for mounting auxiliary parts on an in-line type multi-cylinder engine according to claim 3, wherein said first and second auxiliary parts are driven by an inner peripheral surface of the endless belt, and said third and fourth auxiliary parts are driven by an outer peripheral surface of the endless belt.

5. A structure for mounting auxiliary parts on an in-line type multi-cylinder engine according to claim 1, wherein said plurality of auxiliary parts are disposed spaced apart in a longitudinal direction of said auxiliary part mounting bracket, and wherein one of said auxiliary parts is a water pump disposed at a substantially central portion of said auxiliary part mounting bracket, and said auxiliary mounting bracket includes a cooling water passage extending downstream from said water pump, integrally defined in the longitudinal direction of said auxiliary part mounting bracket.

6. A structure for mounting auxiliary parts on an in-line type multi-cylinder engine according to claim 5, wherein one of said auxiliary parts is an alternator disposed in the vicinity of said water pump.

7. A structure for mounting auxiliary parts on an in-line type multi-cylinder engine according to claim 6, wherein said auxiliary mounting bracket includes a thermo-case having a thermostat accommodated therein, integrally formed on said auxiliary part mounting bracket, and a cooling water passage extending from said thermo-case to said water pump, integrally defined in a direction perpendicular to the longitudinal direction of said auxiliary part mounting bracket, in the vicinity of said alternator.

8. A structure for mounting auxiliary parts on an in-line type multi-cylinder engine according to claim 7, wherein the engine includes an intake manifold and wherein said auxiliary part mounting bracket is disposed at one end of the side of said engine body in the axial direction of the crankshaft, and the intake manifold is disposed at the other end in the axial direction.

* * * * *